US011149939B2

(12) United States Patent
Wilson et al.

(10) Patent No.: US 11,149,939 B2
(45) Date of Patent: Oct. 19, 2021

(54) ILLUMINATING SPEAKER UNIT

(71) Applicant: Roswell Canada Inc., Acheson (CA)

(72) Inventors: Darrick Wilson, Edmonton AB (CA); Colin Brumbaugh, Cocoa Beach, FL (US)

(73) Assignee: ROSWELL CANADA INC., Acheson (CA)

( * ) Notice: Subject to any disclaimer, the term of this patent is extended or adjusted under 35 U.S.C. 154(b) by 0 days.

(21) Appl. No.: 16/869,957

(22) Filed: May 8, 2020

(65) Prior Publication Data

US 2020/0363054 A1 Nov. 19, 2020

Related U.S. Application Data

(60) Provisional application No. 62/846,797, filed on May 13, 2019.

(51) Int. Cl.

| | |
|---|---|
| ***F21V 33/00*** | (2006.01) |
| ***H04R 1/02*** | (2006.01) |
| *F21Y 115/10* | (2016.01) |

(52) U.S. Cl.
CPC ..... *F21V 33/0056* (2013.01); *H04R 1/028* (2013.01); *F21Y 2115/10* (2016.08)

(58) Field of Classification Search
CPC ..... F21V 33/0056; H04R 1/028; H04R 1/025
See application file for complete search history.

(56) References Cited

U.S. PATENT DOCUMENTS

| | | | | |
|---|---|---|---|---|
| 2005/0175209 | A1* | 8/2005 | Powers, Jr. | H04R 1/028 381/355 |
| 2007/0003100 | A1* | 1/2007 | Liu | H04R 1/028 381/412 |
| 2007/0222631 | A1* | 9/2007 | Haase | G08B 7/06 340/691.5 |
| 2008/0143495 | A1* | 6/2008 | Haase | F21K 9/00 340/326 |
| 2008/0225510 | A1* | 9/2008 | Rocha | F21V 33/0056 362/86 |
| 2008/0289557 | A1* | 11/2008 | Seipel | B63B 34/60 114/221 R |
| 2009/0034778 | A1* | 2/2009 | Chi | H04R 1/028 381/394 |
| 2009/0136076 | A1* | 5/2009 | Chi | H04R 1/026 381/387 |
| 2009/0207607 | A1* | 8/2009 | Haase | G08B 7/06 362/234 |
| 2011/0141856 | A1* | 6/2011 | Cho | G04G 11/00 368/11 |
| 2011/0317861 | A1* | 12/2011 | Haase | F21S 8/026 381/333 |
| 2016/0339351 | A1* | 11/2016 | Akishbekov | A63H 33/108 |
| 2020/0107111 | A1* | 4/2020 | Fay | H04R 1/023 |
| 2020/0216147 | A1* | 7/2020 | Herrick | B63B 21/56 |

* cited by examiner

*Primary Examiner* — Keith G. Delahoussaye
(74) *Attorney, Agent, or Firm* — Timothy H. Van Dyke; Wolter Van Dyke Davis, PLLC

(57) ABSTRACT

An apparatus for an audio sound system may include a speaker unit that may include a speaker housing configured to be selectively, at least partially, illuminated. The speaker unit may further include an illumination source configured to at least partially illuminate the speaker housing.

20 Claims, 14 Drawing Sheets

ILLUMINATING SPEAKER UNIT

CROSS-REFERENCE TO RELATED APPLICATION

This application claims the benefit of U.S. Provisional Application No. 62/846,797, filed on 13 May 2019, the contents of which are incorporated herein by reference.

FIELD OF THE INVENTION

The present invention generally relates to a speaker unit for an audio sound system that may include a housing that may be selectively, at least partially illuminated, and/or includes portions that may be selectively, at least partially, illuminated.

BACKGROUND OF THE INVENTION

The essential components of a speaker generally include a speaker cone, a front and rear suspension, a magnet and a voice coil, all of which may be held together by a basket frame. Speakers work by converting electrical energy into mechanical energy in the process of compressing air and converting the motion into sound energy. Particularly, when an audio input is passing through a voice coil, the voice coil may drive a speaker cone to vibrate by the effect of a magnetic field and reproduce the sound. While minimal variations in each component can have a dramatic effect on speaker performance, including, but not limited to enhancing output power and minimizing loss, little attention is paid to enhancing decorative effect.

BRIEF SUMMARY OF DISCLOSURE

In one example implementation, an apparatus for an audio sound system may include a speaker unit. The speaker unit may include a speaker housing configured to be selectively, at least partially, illuminated. The speaker unit may include an illumination source configured to at least partially illuminate the speaker housing.

One or more of the following example features may be included. At least a portion of the speaker housing may be at least one of at least partially translucent and at least partially transparent. The illumination source may be arranged such that light from the illumination source may be directed onto at least the portion of the speaker housing that may be at least one of at least partially translucent and at least partially transparent. The illumination source may be configured to direct light within at least the portion of the speaker housing that may be at least one of at least partially translucent and at least partially transparent. The illumination source may be further configured to at least one of continuously and intermittently illuminate one or more selected portions of the speaker housing. The illumination source may include one or more illumination sources. The illumination source may be configured to emit one or more illumination colors. The illumination source may be configured to provide one or more different illumination intensities. The speaker housing may at least partially include an audio speaker element.

In another example implementation, an apparatus for an audio sound system may include a speaker unit. The speaker unit may include a speaker housing configured to be selectively, at least partially, illuminated. At least a portion of the speaker housing may be at least one of at least partially translucent and at least partially transparent. The speaker unit may include an illumination source configured to at least partially illuminate the speaker housing. The illumination source may be further configured to at least one of continuously and intermittently illuminate one or more selected portions of the speaker housing.

One or more of the following example features may be included. The illumination source may be arranged such that light from the illumination source may be directed onto at least the portion of the speaker housing that may be at least one of at least partially translucent and at least partially transparent. The illumination source may be configured to direct light within at least the portion of the speaker housing that may be at least one of at least partially translucent and at least partially transparent. The illumination source may include one or more illumination sources. The illumination source may be configured to emit one or more illumination colors. The illumination source may be configured to provide one or more different illumination intensities. The speaker housing may at least partially include an audio speaker element.

In another example implementation, an apparatus for an audio sound system may include a speaker unit. The speaker unit may include a speaker housing configured to be selectively, at least partially, illuminated. At least a portion of the speaker housing may be at least one of at least partially translucent and at least partially transparent. The speaker unit may include an illumination source configured to at least partially illuminate the speaker housing. The illumination source may be further configured to at least one of continuously and intermittently illuminate one or more selected portions of the speaker housing. The illumination source may be arranged such that light from the illumination source may be directed onto at least the portion of the speaker housing that is at least one of at least partially translucent and at least partially transparent. The illumination source may be configured to direct light within at least the portion of the speaker housing that may be at least one of at least partially translucent and at least partially transparent.

One or more of the following example features may be included. The illumination source may include one or more illumination sources. The illumination source may be configured to emit one or more illumination colors. The illumination source may be configured to provide one or more different illumination intensities.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
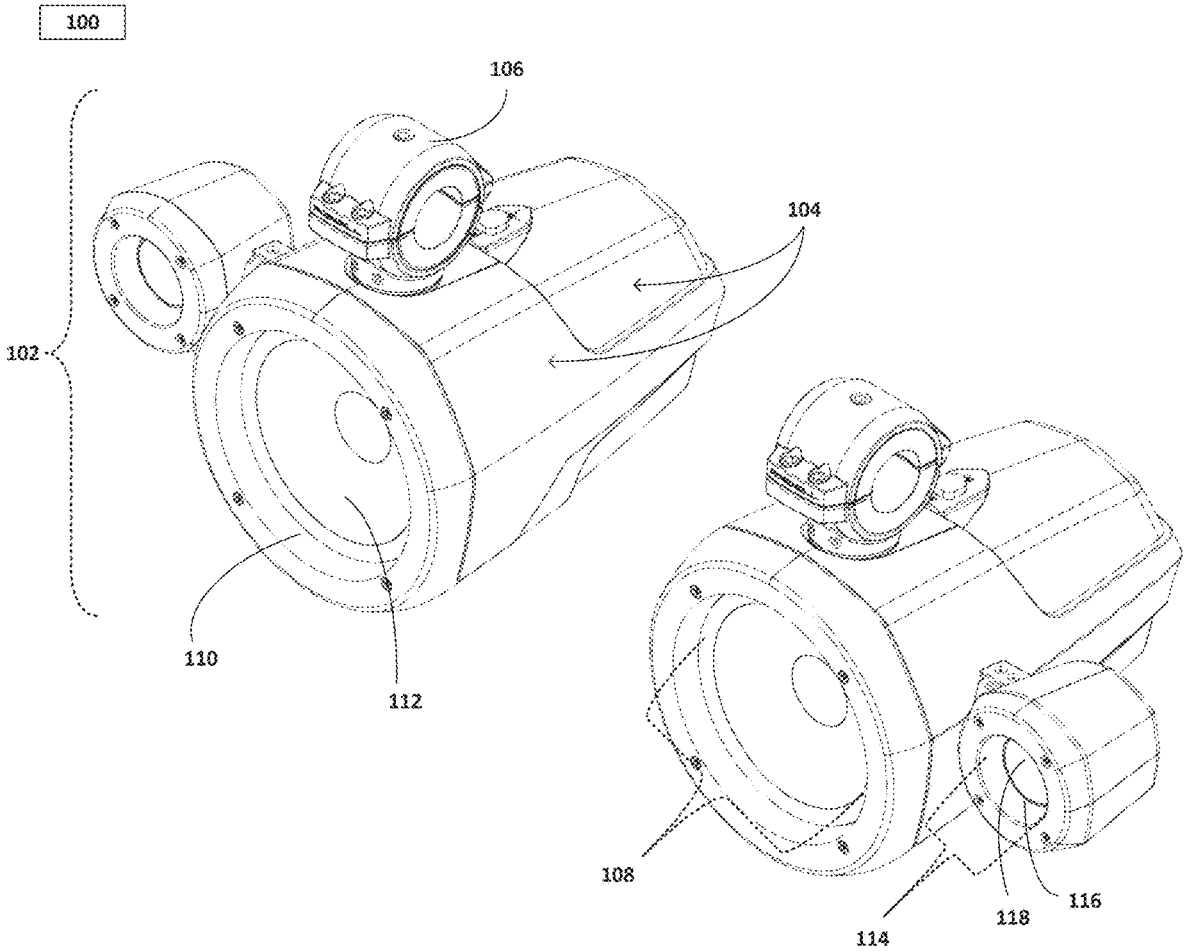
FIG. 1 is an illustrative perspective view of a pair of illustrative example embodiments of speaker units with a speaker housing in a non-illuminated configuration according to one or more example implementations of the disclosure.
Figure 2:
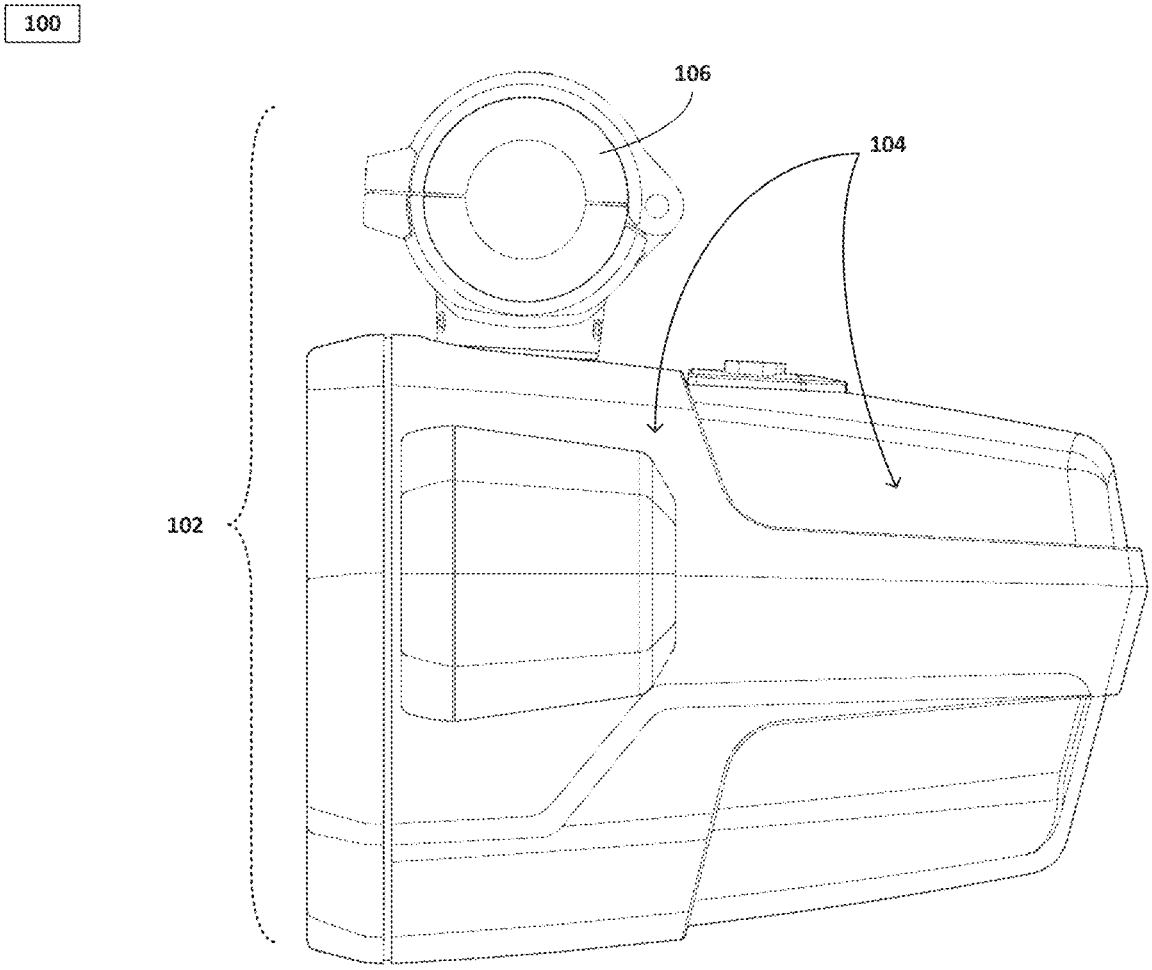
FIG. 2 is a side view of a speaker unit of FIG. 1 with the speaker housing in the non-illuminated configuration according to one or more example implementations of the disclosure.

In general, the present disclosure may provide an apparatus for an audio sound system that may include a speaker unit. In some illustrative example embodiments, the speaker unit may be configured for use with outdoor recreational equipment. However, the speaker unit may, in some embodiments, be otherwise configured. The speaker unit may include speaker housing that may be configured to be selectively, at least partially, illuminated. The speaker unit may include an illumination source that may be configured to at least partially illuminate the speaker housing.

Consistent with the foregoing, in some illustrative example implementations, an apparatus for an audio sound system may include a speaker unit configured for use with outdoor recreational equipment. For example, and with reference to the example embodiments of FIGS. 1-14, illustrative example embodiments of speaker units (e.g., speaker units 102, 102*a*, 102*b*) are shown. Consistent with illustrated configurations, speaker units may be particularly configured for use with outdoor recreational equipment, and in some embodiments particularly configured for use with outdoor recreational power equipment. For example, in some embodiments a speaker unit consistent with the present disclosure may be configured for use with a marine power craft, such as a personal watercraft, power boats (e.g., including, but not limited to boats for towing individuals participating in watersports such as water skiing, wakeboarding, wake surfing, fishing, etc.), and the like. For example, speaker unit 102 may include clamp 106 configured for mounting speaker unit 102 on various types and sizes of boats (e.g., by mounting the speaker unit to tower structures, railings, bimini structures, water sports equipment storage racks, and the like), general and specific in use, including wakeboard, surf, waterski, family, cruiser, runabouts, fish boats, pontoon and other deck boats of the like. It will be appreciated that a variety of different clamps, or other mounting features, of the speaker unit may be utilized, e.g., which may provide similar and/or different mounting configurations and/or facilitate mounting to different surfaces and/or structures.

It will be appreciated that speaker units consistent with the present disclosure may be used in connection with various additional and/or alternative vehicles and/or applications and may include various alternative means (e.g., mount, bracket, quick-release clamp, eye bolt clamp, etc.) for mounting the speaker unit to the various additional and/or alternative vehicles and/or applications. For example, speaker units consistent with the present disclosure may be utilized in connection with off-road vehicles. ATV's, go-karts, golf carts, etc.

In some implementations, the speaker unit may include a speaker housing configured to be selectively, at least partially, illuminated. Referring to the drawings, various illustrative example embodiments are shown. For example, and referring at least to FIGS. 1-6, one example embodiment of speaker unit 102 is shown, in which FIGS. 1, 2, 4, and 5 may variously depict an example embodiment of speaker housing 104 in a non-illuminated configuration, and FIGS. 3 and 6 may variously depict an example embodiment of speaker housing 104 being illuminated, e.g., through the use of shading. Consistent with this configuration, speaker housing 104 may be selectively, at least partially, illuminated, and/or include portions that may be selectively, at least partially, illuminated. As will be discussed in greater detail below, in some implementations, one or more portions of speaker housing 104 may be formed from an at least partially translucent and/or transparent material, and the one or more portions of speaker housing 104 that are not intended to be illuminated may be formed from materials that are not translucent and/or transparent.

As generally discussed above, in some implementations, at least a portion of speaker housing 104 may be at least one of at least partially translucent and at least partially transparent. For example, one or more portions of speaker housing 104 intended to be illuminated may be formed from an at least partially translucent and/or transparent material, and one or more portions of speaker housing 104 that are not intended to be illuminated may be include materials that are not translucent and/or transparent. In this regard, and in some embodiments, one or more portions of speaker housing 104 that are not intended to be illuminated may be formed from the translucent and/or transparent material, but may include a light blocking feature, such as an interior or exterior coating (e.g., paint, metallization, over-molded portion, etc.), additional materials/components that may block illumination, and the like. Accordingly, it may be possible to form one or more portions of speaker housing 104 from a translucent and/or transparent material, while maintaining selective portions of speaker housing 104 configured for being illuminated.

Consistent with the present disclosure, it will be appreciated that the portions intended to be selectively illuminated may be formed from any suitable translucent and/or transparent material, such as, but not limited to, a suitable plastic, glass, etc. Similarly, the portions not intended to be selectively illuminated may be formed from any suitable material such as, but not limited to, plastic, metal, fiberglass, etc. In some such embodiments, the translucent and/or transparent portions of the speaker housing and the opaque portions of the speaker housing may be co-molded to provide at least a portion of the speaker housing (e.g., with translucent and/or transparent features molded into an otherwise opaque speaker housing/housing portion or vice-versa), may be assembled to one another (e.g., mechanically fastened to one another, welded to one another, adhesively bonded to one another and/or assembled to a common or related structure) to provide the speaker housing/housing portion. Additionally and/or alternatively, as discussed above, at least a portion of the speaker housing may be formed from a translucent and/or transparent material, and portions of the translucent and/or transparent material, not intended to be illuminated, may include an opaque coating as a light blocking feature (e.g., by painting, metallizing, over-molding, etc.), e.g., on an exterior and/or interior of the speaker housing, depending upon the illuminating arrangement (as discussed in greater detail below).

Figure 3:
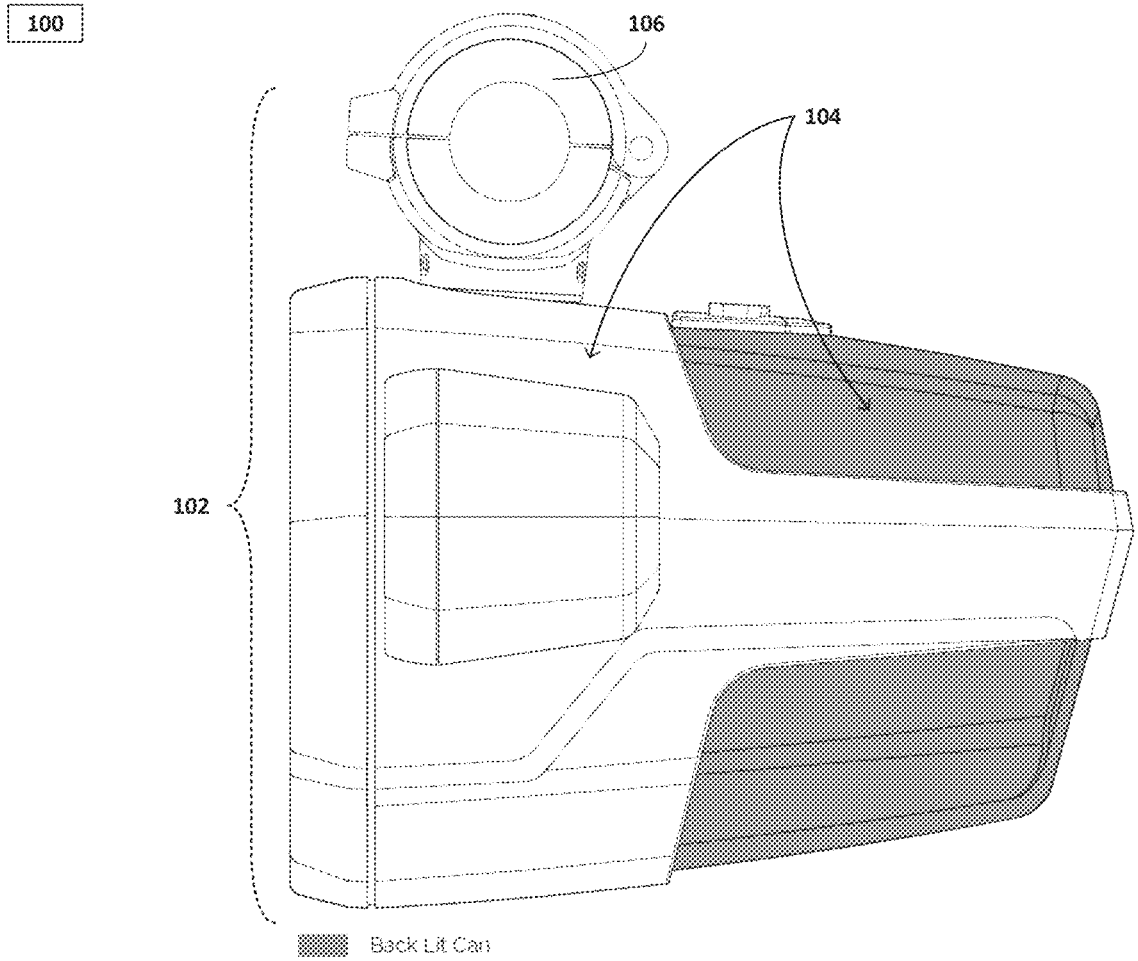
FIG. 3 is a side view of a speaker unit of FIG. 1 with the speaker housing in an illuminated configuration according to one or more example implementations of the disclosure.
Figure 4:
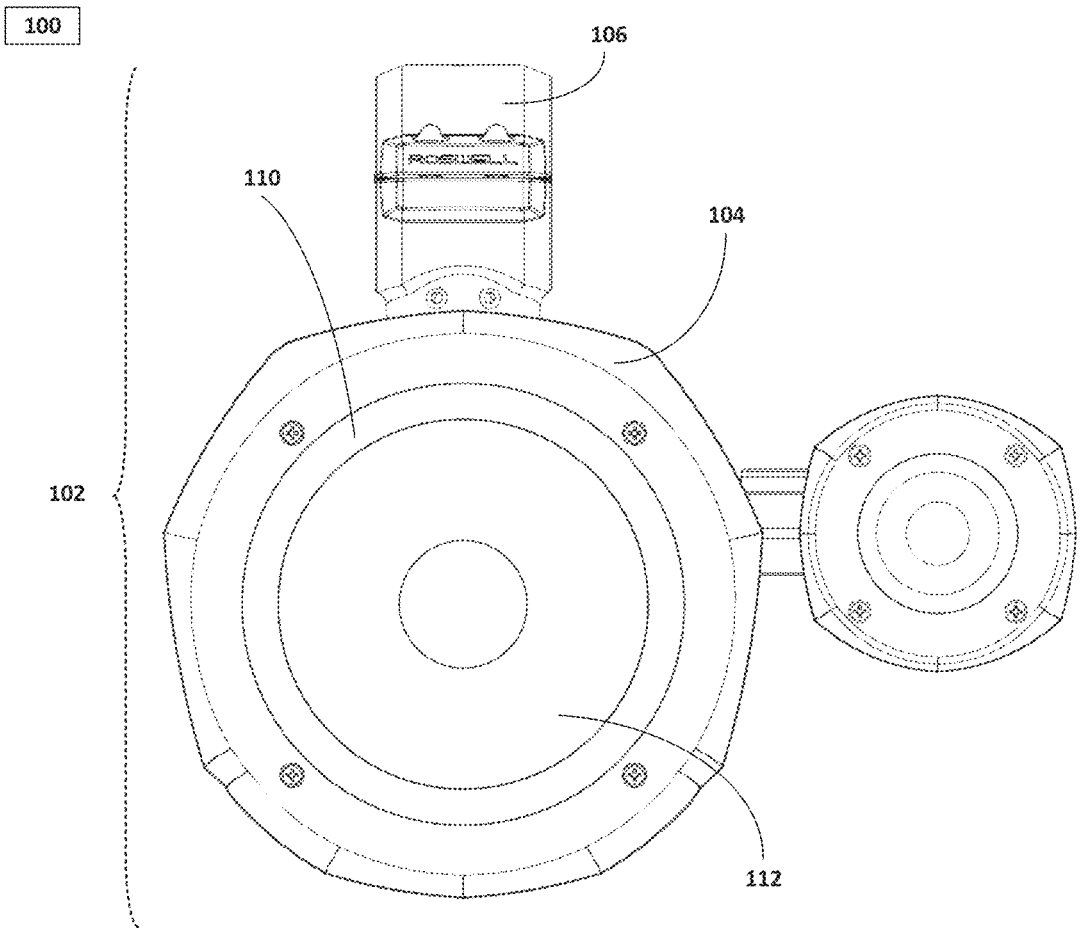
FIG. 4 is a front view of a speaker unit of FIG. 1 with the speaker housing in the non-illuminated configuration according to one or more example implementations of the disclosure.
Figure 5:
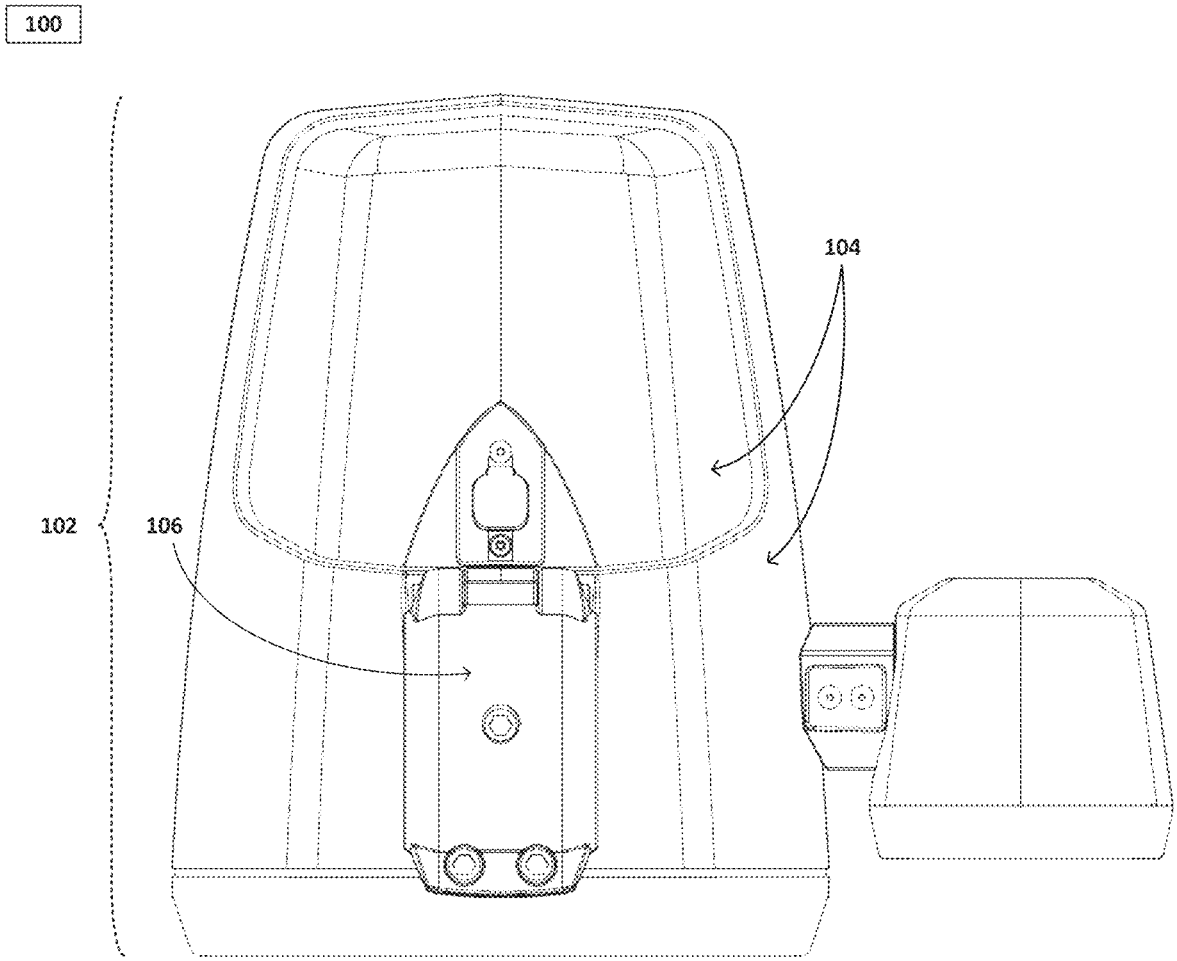
FIG. 5 is a top view of a speaker unit of FIG. 1 with the speaker housing in the non-illuminated configuration according to one or more example implementations of the disclosure.
Figure 6:
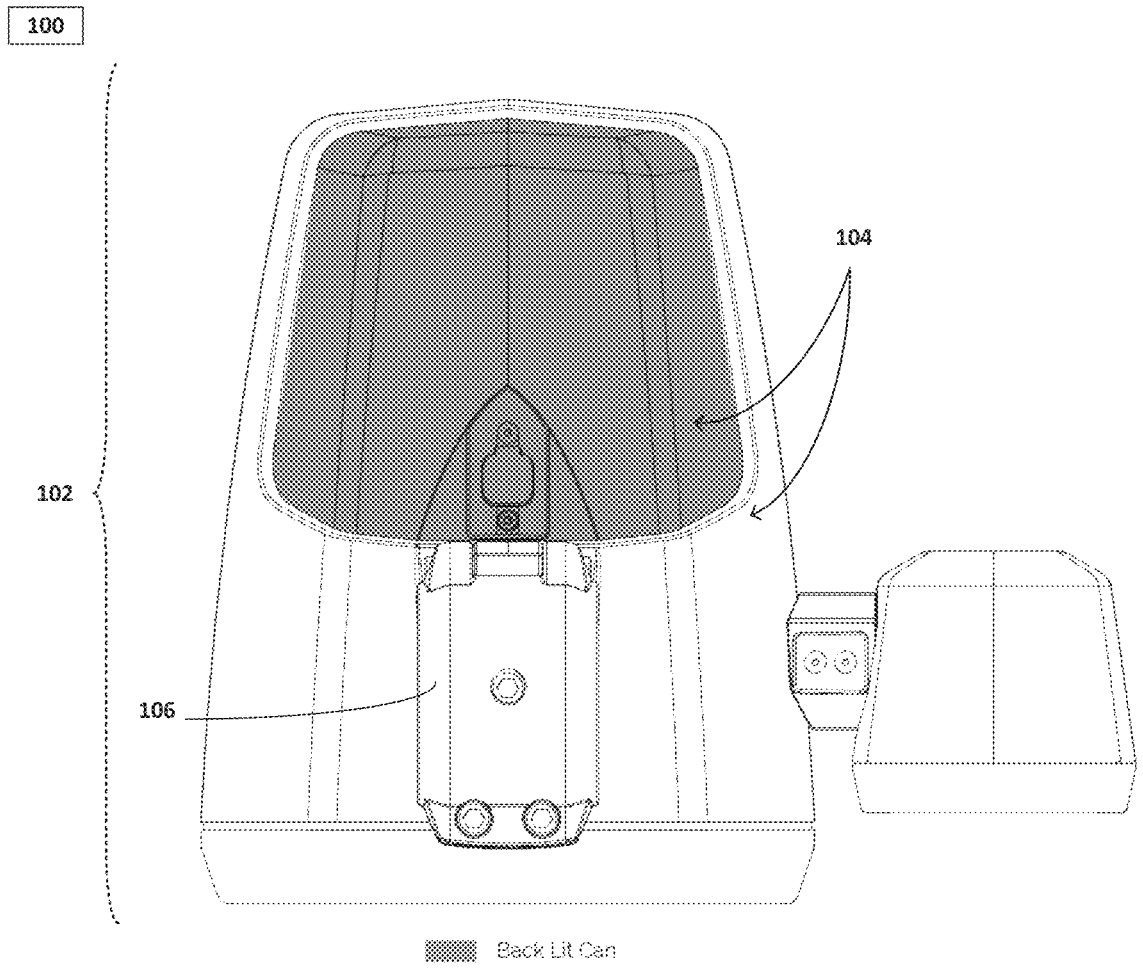
FIG. 6 is a top view of a speaker unit of FIG. 1 with the speaker housing in the illuminated configuration according to one or more example implementations of the disclosure.
Figure 7:
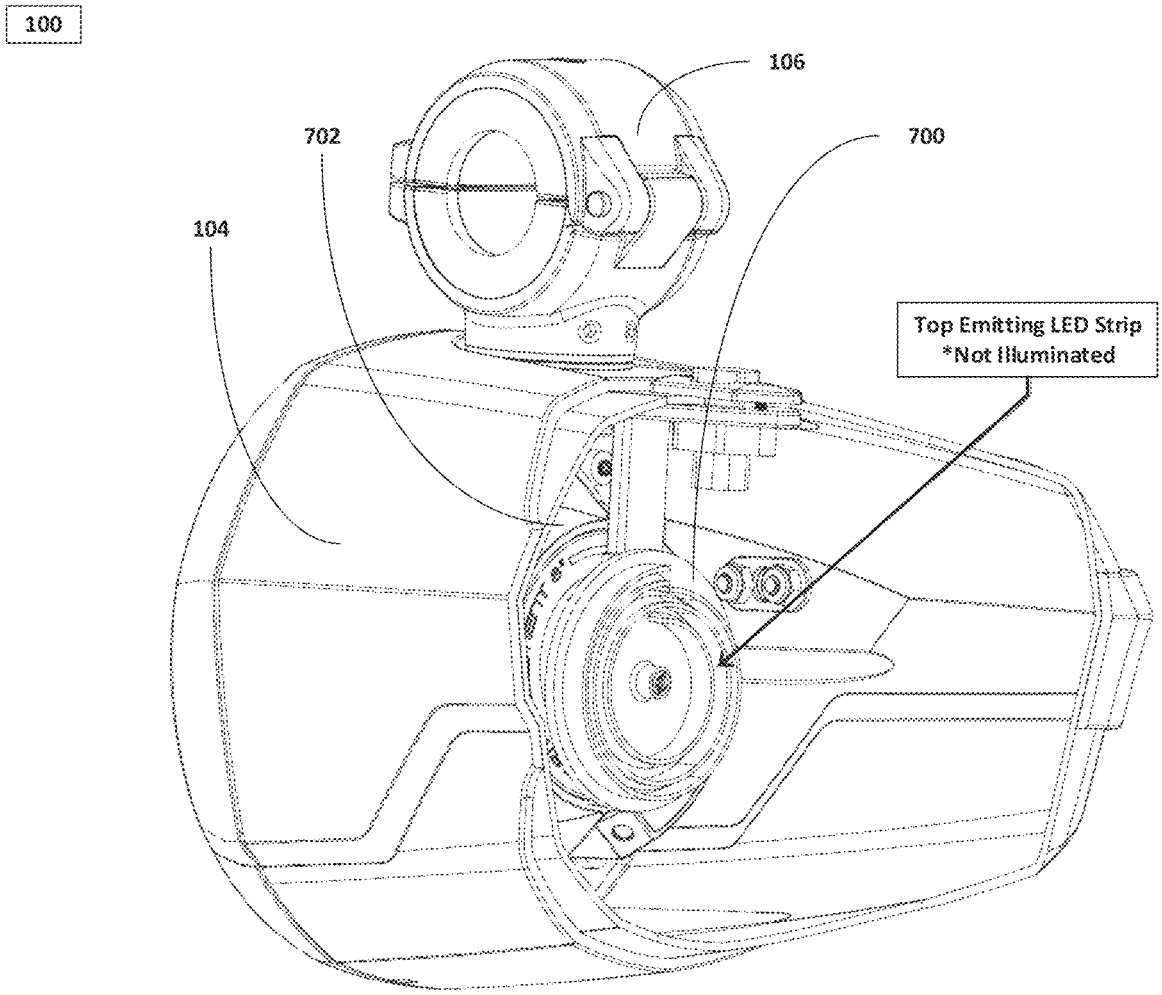
FIG. 7 is a partial sectional view of a speaker unit of FIG. 1 with the speaker housing in the non-illuminated configuration according to one or more example implementations of the disclosure.
Figure 8:
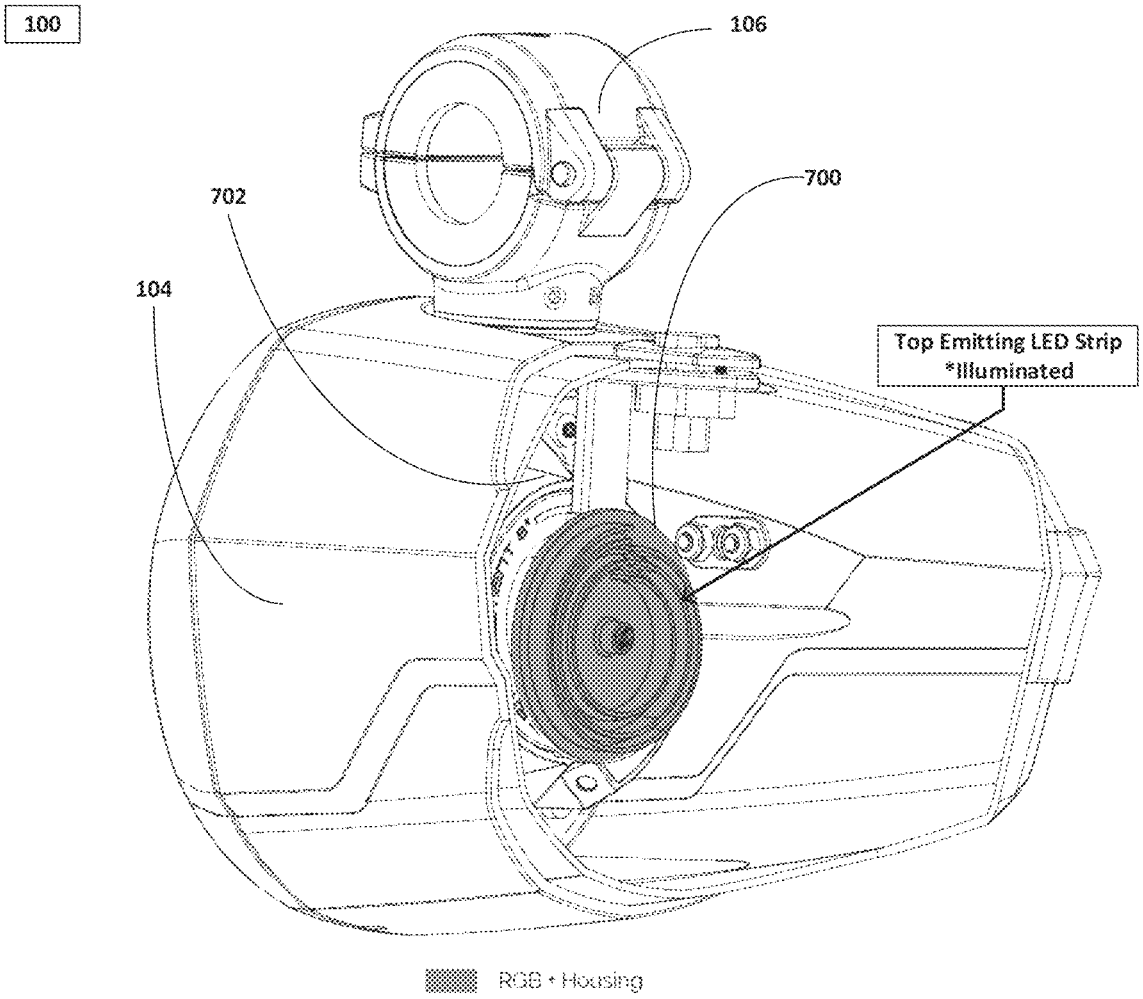
FIG. 8 is a partial sectional view of a speaker unit of FIG. 1 with the speaker housing in the illuminated configuration according to one or more example implementations of the disclosure.

In some implementations, the speaker unit may include an illumination source configured to at least partially illuminate the speaker housing. For example, speaker unit 102 may further include illumination source 700 configured to at least partially illuminate one or more translucent and/or transparent portions of speaker housing 104 (at least a portion of the otherwise translucent and/or transparent speaker housing which may include an opaque coating, in some embodiments, to provide portions that may not be selectively illuminated). Referring at least to FIGS. 7 and 8, an illustrative example embodiment of speaker unit 102 consistent with the present disclosure is shown, of which variously depict partial sectional views of an example embodiment of an interior portion of the example speaker unit 102. Consistent with the example embodiment of the present disclosure, speaker unit 102 may include a top emitting LED strip with a clear housing as illumination source 700. For example, the top emitting LED strip is shown in a non-illuminated configuration in FIG. 7, and in an illuminated configuration in FIG. 8. Consistent with these configurations, the top emitting LED strip of illumination source 700 may illuminate at least a portion of the interior of speaker housing 104. When at least a portion of interior of speaker housing 104 is illuminated, the illumination from the top emitting LED strip may be transmitted through one or more at least partially transparent and/or translucent desired regions of speaker housing 104, as shown in FIGS. 3 and 6, effectively using speaker housing 104 as a light pipe, including transmitting it through one or more portions that may be coated/masked and therefore do not appear illuminated from the exterior of the speaker. In this regard, and in some embodiments, the interior and/or exterior of speaker housing 104 may be coated with an at least partially reflective coating (e.g., on a surface facing the body) to assist in transmitting the light through the body.

As will be discussed in more detail below, the illumination source (e.g., illumination source 700) may include one or more illumination sources of varying colors and/or intensities. In some implementations, illumination by each of the one or more illumination sources and/or the pattern of illumination by each of the one or more illumination sources may be random and/or may be programmable such that some translucent and/or transparent portions of speaker housing 104 may be continuously illuminated and/or intermittently illuminated, including being intermittently illuminated at the same time and/or at different times from one another, illuminated at the same intensity and/or at different intensities from one another, and/or illuminated in the same color and/or different colors from one another, and/or various combinations of the foregoing (e.g., one or more of region of illumination, intensity of illumination, and color of illumination may be different and/or be different at different times).

In some implementations, illumination source 700 may be arranged such that light from illumination source 700 is directed onto at least the portion of an interior of speaker housing 104 that is at least one of at least partially translucent and at least partially transparent. For example, speaker unit 102 may include illumination source 700 configured to at least partially illuminate an interior surface of one or more translucent and/or transparent portions of the speaker housing. Consistent with the present disclosure, illumination source 700 may be arranged such that light from illumination source 700 is directed onto the an interior surface of one or more translucent and/or transparent portions of speaker housing 104, and transmitted through the one or more translucent and/or transparent portions of speaker housing 104 to provide observable (e.g., by an individual viewing the speaker unit 102) illumination of the one or more translucent and/or transparent portions of speaker housing 104. For example, illumination source 700 may be at least partially and/or fully disposed within speaker housing 104, and may be arranged to direct light onto an interior surface of at least the one or more translucent and/or transparent portions of speaker housing 104, thereby giving rise to an illuminated appearance of the one or more translucent and/or transparent portions of speaker housing 104.

In some implementations, illumination source 700 is configured to direct light within at least the portion of speaker housing 104 that is at least one of at least partially translucent and at least partially transparent. Referring to at least FIGS. 3 and 6, when at least a portion of speaker housing 104 is illuminated, the illumination may be transmitted through one or more at least partially transparent regions of speaker housing 104. For example, illumination source 700 may direct light into one or more translucent and/or transparent portions of speaker housing 104. Based upon the translucent and/or transparent nature of the one or more portions of speaker housing 104, the translucent and/or transparent portions of speaker housing 104 may distribute the light through the one or more translucent and/or transparent portions of speaker housing 104 to provide an illuminated appearance of the one or more translucent and/or transparent portions of speaker housing 104. In some such embodiments, the translucent and/or transparent regions of the speaker housing may effectively serve as a transmission and/or distribution medium for the light, e.g., generally in the manner of a light pipe or similar structure. It should be noted that translucent and/or transparent regions of the speaker housing may include regions that may include a light blocking coating or structure. As such, the translucent and/or transparent regions of the speaker housing including the light blocking coating or structure may still act as a transmission or distribution medium for the light, even if the regions do not appear illuminated to an observer of the speaker unit.

In some implementations, the illumination source may be configured to at least one of continuously and intermittently illuminate one or more selected portions of speaker housing. For example, in an example embodiment providing multiple illumination colors, the different illumination colors may be provided simultaneously, sequentially, or in an at least partially time-wise overlapping manner. Consistent with this configuration, various translucent and/or transparent portions of speaker housing 104 may be illuminated at different times. For example, one or more of the translucent and/or transparent portions of speaker housing 104 may be continuously illuminated, and one or more of the translucent and/or transparent portions of speaker housing 104 may be intermittently illuminated. In still further example embodiments, multiple different translucent and/or transparent portions of speaker housing 104 may be intermittently illuminated, including intermittently illuminated at the same time and/or at different times from one another. In some implementations, the intermittent illumination may be based on a variety of different occurrences or inputs. For example, the frequency, duration, illumination span, etc., of the intermittent illumination may be based upon, at least in part, a characteristics (such as a beat or tempo) of music played through the speakers, a speed of the vehicle (e.g., boat, ATV, golf cart, off-read vehicle, etc.), and/or a variety of other occurrences. It will be appreciated that various additional and/or alternative configurations may also be implemented.

In some implementations, the illumination source may include one or more illumination sources. For example, speaker unit 102 may include illumination source 700 positioned within an interior portion of speaker housing 104, wherein illumination source 700 may include one or more illumination sources (e.g., one or more individual LEDs, incandescent bulbs, or other features capable of causing illumination) configured to at least partially illuminate one or more translucent and/or transparent portions of speaker housing 104. In some implementations, a single illumination source may be utilized for illuminating the one or more translucent and/or transparent portions of speaker housing 104. In other embodiments, multiple illumination sources may be utilized, e.g., for illuminating different portions of speaker housing 104, for providing more uniform illumination of different portions of speaker housing 104, for providing varying illumination intensities, for providing different illumination colors, and the like. Consistent with the present disclosure, the one or more illumination sources may be configured to directly, or indirectly, illuminate the one or more translucent and/or transparent portions of speaker housing 104. Consistent with various embodiments, and as generally noted above, any suitable illumination source may be utilized. For example, suitable illumination sources may include, but are not limited to, LEDs, incandescent bulbs, and the like.

In some implementations, the illumination source may be configured to emit one or more illumination colors. As generally discussed above, one or more illumination sources may be utilized for illuminating the one or more translucent and/or transparent portions of speaker housing 104. Consistent with this configuration, the one or more illumination sources may include a single illumination source or multiple illumination sources (e.g., which may include more than one discrete illumination source, such as more than one LED, incorporated into a common unit, or assembly, such as a PCB board or the like), wherein the one or more illumination sources may utilize one or more illumination colors. For example, a single illumination color may be utilized by a single illumination source or by multiple illumination sources. In some implementations, more than one illumination color may be utilized. For instance, more than one illumination color may be utilized through the use of multiple illumination sources providing different illumination colors, through the use of a single illumination source providing different illumination colors through the use of colored filters (e.g., which may, in some embodiments, be associated with fiber optics, light cables, or light pipes providing colored illumination output via color filters or color tinting of the transmission medium, etc.). In some particular embodiments, speaker unit 102 may include one or more translucent and/or transparent portions that may be selectively illuminated with one or more combinations of red, green, and blue (and or other color) illumination sources. In some embodiments, illumination colors may be selectively and/or intermittently combined, e.g., to provide further possible illumination colors. In some embodiments, the illumination color provided to a given translucent and/or transparent portion of the speaker housing may change over time. Such changes in color may include abrupt changes from one color to another and/or may transition from one color to another color over time (e.g., any time from less than a second to several seconds or even minutes). Such color transitions over time may include transitions to intermediary colors or shades.

In some implementations, the illumination source may be configured to provide one or more different illumination intensities. As generally discussed above, the one or more illumination sources may include a single illumination source or multiple illumination sources. For example, more than one different illumination intensity may be provided by a single illumination source (e.g., which may be dimmable to provide different illumination outputs), by different illumination sources providing respective different illumination outputs, and/or by multiple illumination sources providing different aggregate illumination outputs (e.g., based upon, at least in part, the number of illumination sources providing illumination for a given translucent and/or transparent portion of the speaker housing). The illumination intensity provided to different translucent and/or transparent regions of speaker housing 104 may differ from one another, and/or the illumination intensity provided to a given translucent and/or transparent region of speaker housing 104 may vary over time. Variations in illumination intensity provided to any given (and/or multiple) translucent and/or transparent regions of speaker housing 104 may occur abruptly and/or may vary over time (e.g. any time from less than a second to several seconds or even minutes).

In some implementations, the speaker unit may include an audio speaker element, e.g., which may be at least partially disposed within the speaker housing. For example, and referring at least to the illustrated example embodiment of FIGS. 1-8, speaker housing 104 may at least partially include audio speaker element 108 positioned within an interior portion of speaker housing 104. Consistent with this configuration, audio speaker element 108 may include speaker cone (or diaphragm) 112, and speaker coil (or magnet) 702. As is generally understood, audio speaker element 108 may provide the production and transmission of sound for speaker unit 102.

Referring to FIGS. 9-14, additional illustrative example embodiments are depicted. As shown in the illustrated embodiments, various portions of speaker housing 104, including various portions of bezel 110 at least partially surrounding speaker cone 112*a*, may be capable of being illuminated. As generally discussed above, various translucent and/or transparent portions of speaker housing 104*a* may be illuminated at different times, in different colors, and/or at different illumination intensities. Consistent with various embodiments of the present disclosure, some translucent and/or transparent portions of speaker housing 104*a* may be continuously illuminated, and other translucent and/or transparent portions of speaker housing 104*a* may be intermittently illuminated.

In still further example embodiments, multiple different translucent and/or transparent portions of speaker housing 104*a* may be intermittently illuminated, including intermittently illuminated at the same time and/or at different times from one another. For example, illumination may only be provided in conjunction with use of audio speaker element 108 (e.g., when speaker unit 102 is being utilized to transmit audio). In an example of such an implementation, the illumination may provide a visual effect along with the audio output. In some implementations, illumination may be independent from the use of the audio speaker element (e.g., when illumination of audio speaker element is being used to provide lighting, such as, e.g. ambiance lighting without the use of the audio system).

In some illustrative example implementation, apparatus 100*c* for an audio sound system may include a speaker unit configured for use with outdoor recreational equipment. As noted above, a speaker unit consistent with the present disclosure may be configured for use with a marine power craft, such as a personal watercraft, power boats (e.g., including, but not limited to boats for towing individuals participating in watersports such as water skiing, wakeboarding, wake surfing, fishing, etc.), and the like. For example, a speaker unit consistent with the present disclosure may be configured to be mounted to a Bimini system of a boat, a towing tower of a boat (e.g., a tower or other structure that may be utilized for towing a water skier, wake surfer, or the like), a fishing tower of a boat, or any other suitable structure of a boat.

In still further example embodiments, a speaker unit consistent with the present disclosure may be used in connection with other power sports and/or utility vehicles, including, but not limited to, golf carts, and off-road vehicles (such as, for example, all-terrain vehicles, quads, and the like). Consistent with such implementations, and referring again to at least FIGS. 1-6, speaker unit 102 may be mounted, via clamp 106, to a roll bar, cage, T-top, or other structure of a power sports and/or utility vehicle.

In some implementations, a speaker unit may include a speaker housing (e.g., speaker housing 104, 104*a*) configured to be selectively, at least partially, illuminated. At least a portion of speaker housing 104, 104*a* may be at least one of at least partially translucent and at least partially transparent. For example, at least a portion of speaker housing 104, 104*a* may include a material that is at least partially translucent and/or transparent. Consistent with this configuration, one or more portions of speaker housing 104, 104*a* intended to be illuminated may be formed from an at least partially translucent and/or transparent material. Examples of suitable translucent and/or transparent materials may include, but are not limited to, high density polyethylene, polycarbonate, polypropylene, acrylic, as well as various other translucent and/or transparent materials.

In some implementations, speaker unit 102 may further include illumination source 700 configured to at least partially illuminate speaker housing 104. Illumination source 700 may be further configured to at least one of continuously and intermittently illuminate one or more selected portions of speaker housing 104.

As noted above, speaker unit 102 may include a top emitting LED strip with a clear housing as illumination source 700. The top emitting LED strip is shown in a non-illuminated configuration in FIG. 7, and in an illuminated configuration in FIG. 8. It will be appreciated that the illustrated top emitting LED strip is only one possible illumination source, and that other suitable illumination sources may be utilized.

In some implementations, the illumination source (e.g., illumination source 700) may be arranged such that light from illumination source 700 may be directed onto at least the portion of speaker housing 104 that may be at least one of at least partially translucent and at least partially transparent. In some implementations, illumination source 700 may be configured to direct light within at least the portion of speaker housing 104 that may be least one of at least partially translucent and at least partially transparent. Consistent with such a configuration, one or more portions of speaker housing 104 may be capable of being illuminated to provide various illuminated shapes, patterns, or designs on speaker housing 104. It will be appreciated that additional and/or alternative portions of speaker housing 104 may be illuminated.

In some implementations, the illumination source (e.g., illumination source 700) may include one or more illumination sources. As noted above, speaker unit 102 may include illumination source 700 positioned within an interior portion of speaker housing 104, wherein illumination source 700 may include one or more illumination sources configured to at least partially illuminate one or more translucent and/or transparent portions of speaker housing 104. In some implementations, illumination by each of the one or more illumination sources and/or the pattern by each of the one or more illumination sources may be random and/or may be programmable (e.g., by a user and/or by a manufacturer). In some implementations, the one or more portions of speaker housing 104 that are illuminated, and/or various in the one or more portions of speaker housing 104 that are illuminated over time, may vary randomly and/or may be programmable (e.g., by a user and/or by a manufacturer).

In some implementations, the illumination source (e.g., illumination source 700) may be configured to emit one or more illumination colors. Consistent with the present disclosure, multiple illumination sources may be utilized, for example, for illuminating different portions of speaker housing 104, for providing a more uniform illumination of different portions of speaker housing 104, for providing varying illumination intensities (e.g., dimming or brightening feature), and/or for providing different illumination colors, and the like. In an example embodiment providing multiple illumination colors, the different illumination colors may be provided simultaneously, sequentially, or in an at least partially time-wise overlapping manner. Further, in addition/as an alternative to more than one illumination source, a single illumination source may be used in conjunction with one or more filters, or the like, for providing different illumination colors and/or different illumination intensities.

It will be appreciated that the order and/or pattern in which one or more illumination colors are provided in simultaneous, sequential, or in an at least partially time-wise overlapping manner may be customized. For example, the one or more illumination colors may be customized to play in synchronized fashion with the beat of a music track played through the speaker unit, or may independently display the same order and/or pattern without simultaneous audio output (i.e., solely for ambiance lighting).

In some implementations, the illumination source (e.g., illumination source 700) may be configured to provide one or more different illumination intensities. As generally discussed above, the one or more illumination sources may include a single illumination source or multiple illumination sources. For example, more than one different illumination intensity may be provided by a single illumination source, by different illumination sources providing respective different illumination outputs, and/or by multiple illumination sources providing different aggregate illumination outputs. Consistent with this example, more than one different illumination intensity may be provided, e.g., by a single illumination source, by different illumination sources providing respective different illumination outputs, and/or multiple illumination sources providing different aggregate illumination outputs.

Figure 9:
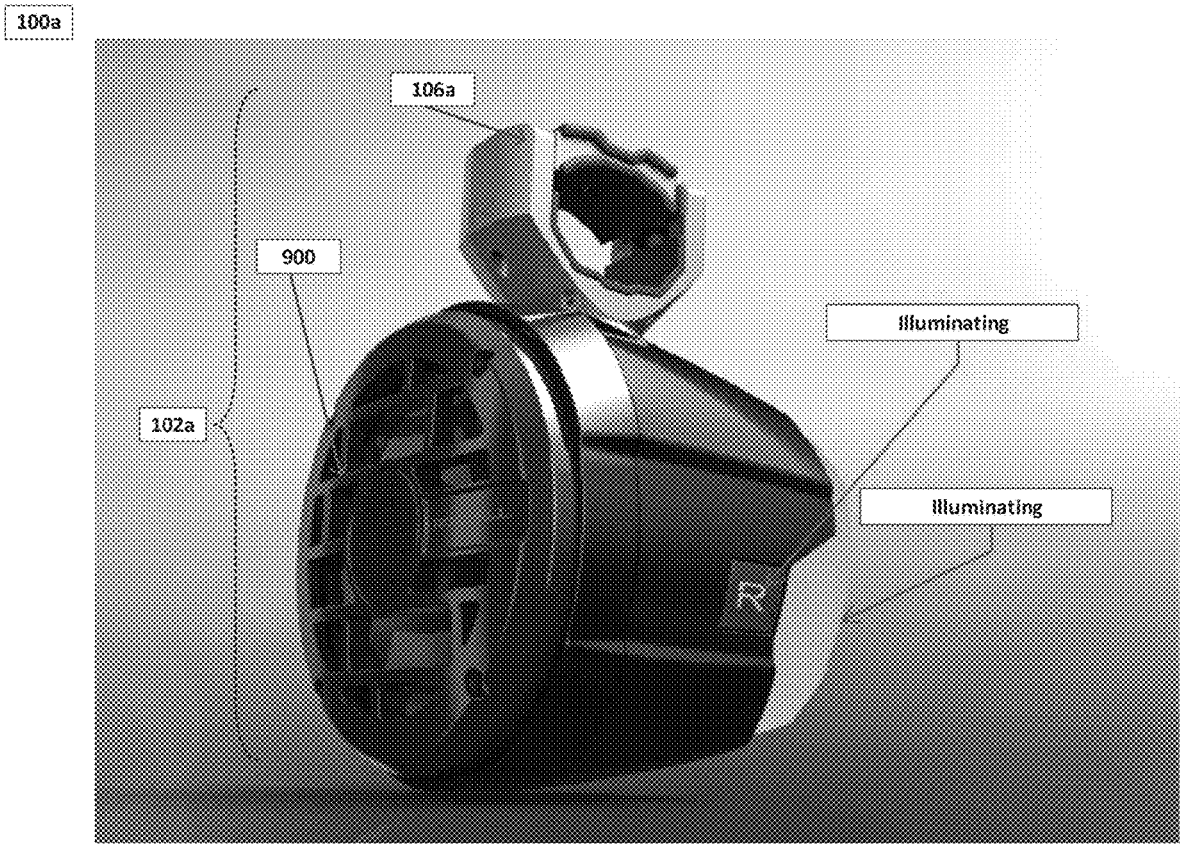
FIG. 9 is a perspective view of another illustrative example embodiment of a speaker unit with a speaker housing in an illuminated configuration according to one or more example implementations of the disclosure.
Figure 10:
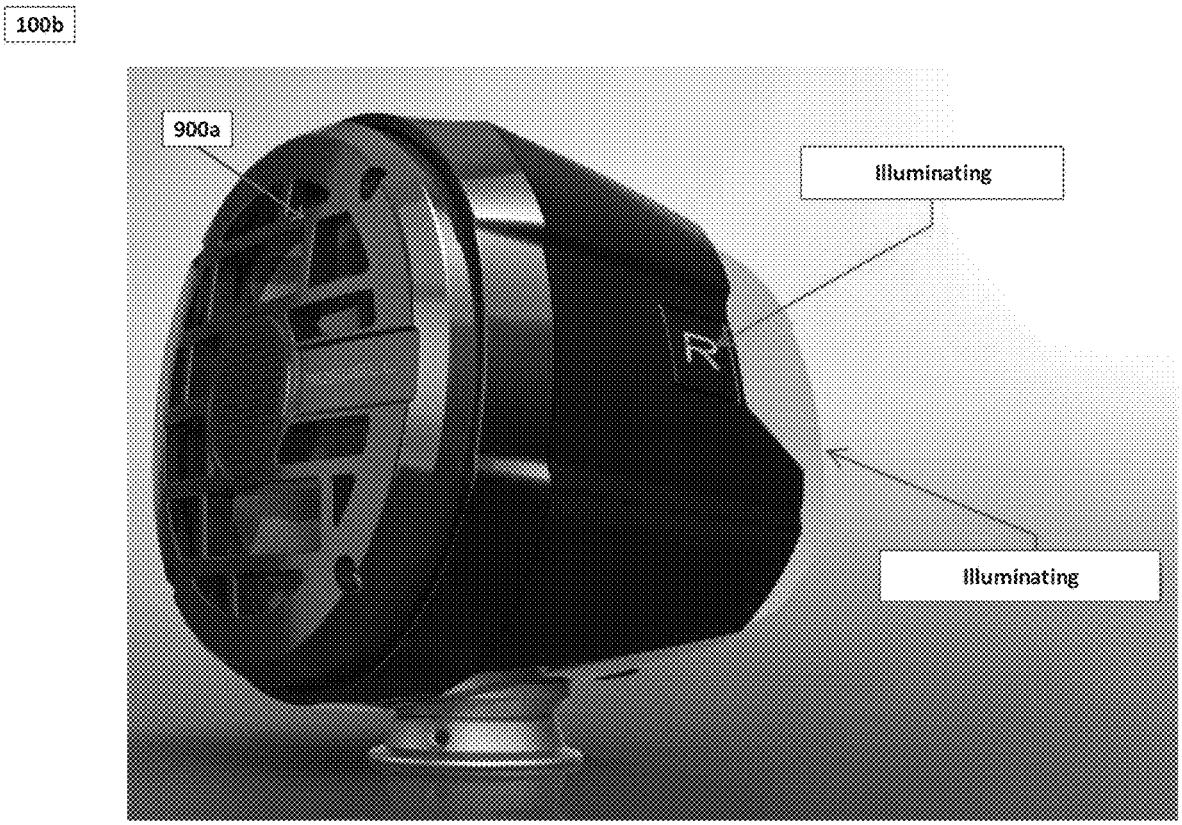
FIG. 10 is a perspective view of another illustrative example embodiment of a speaker unit with a speaker housing in an illuminated configuration according to one or more example implementations of the disclosure.
Figure 11:
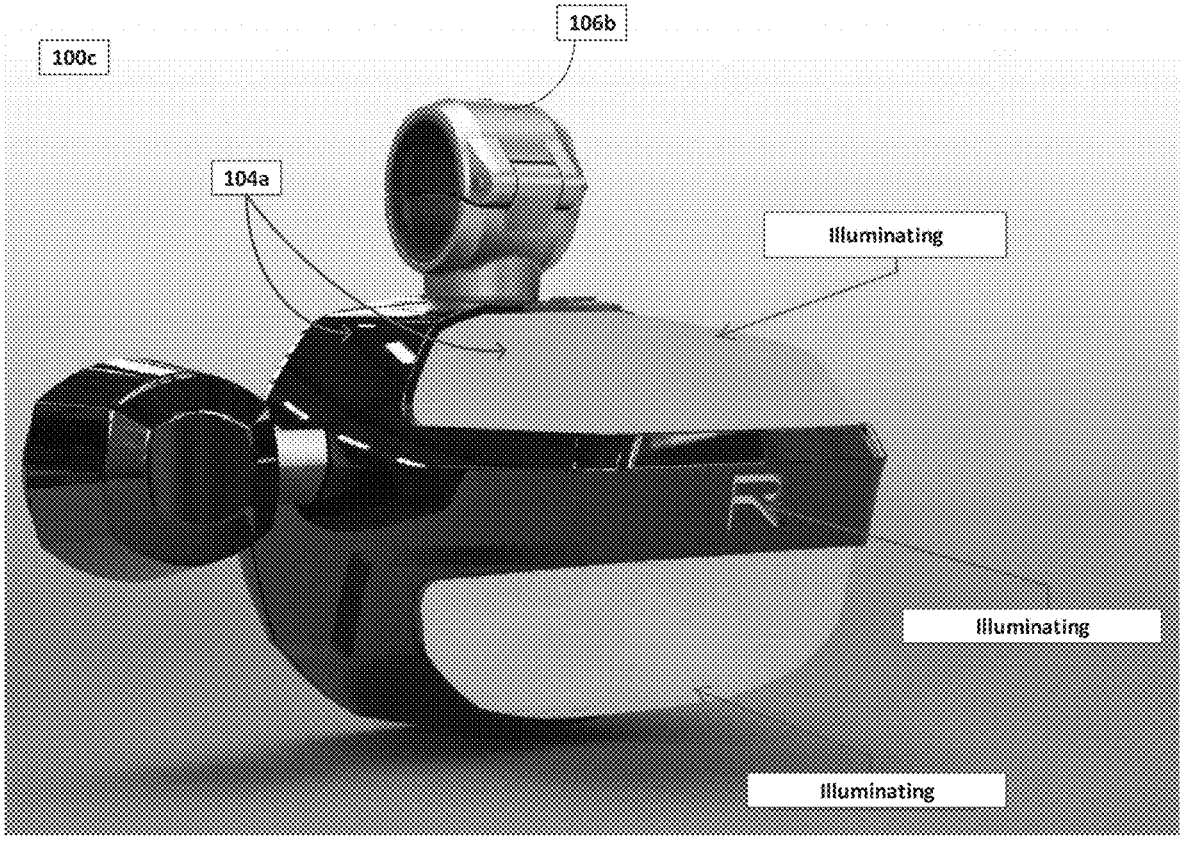
FIG. 11 is a perspective view of an example implementation of the speaker unit of FIG. 1 with the speaker housing in the illuminated configuration according to one or more example implementations of the disclosure.
Figure 12:
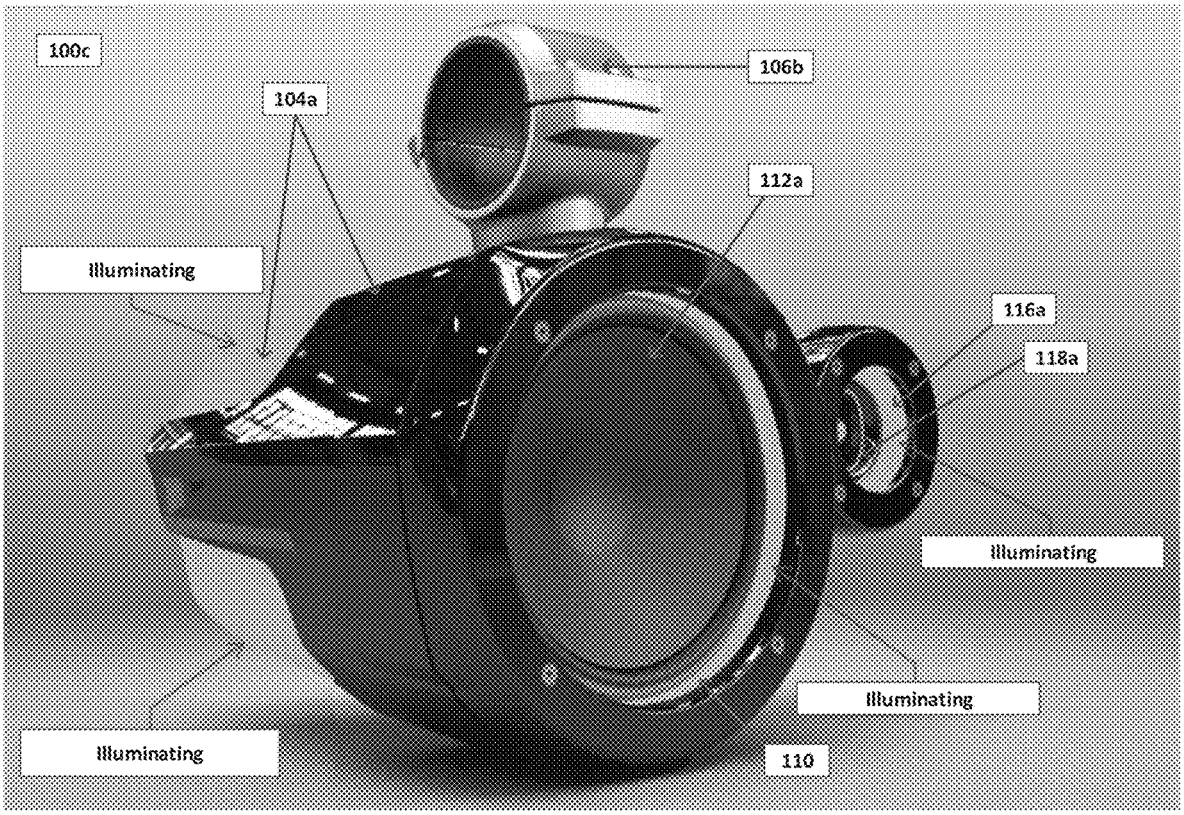
FIG. 12 is a perspective view of an example implementation of the speaker unit of FIG. 1 with the speaker housing in the illuminated configuration according to one or more example implementations of the disclosure.
Figure 13:
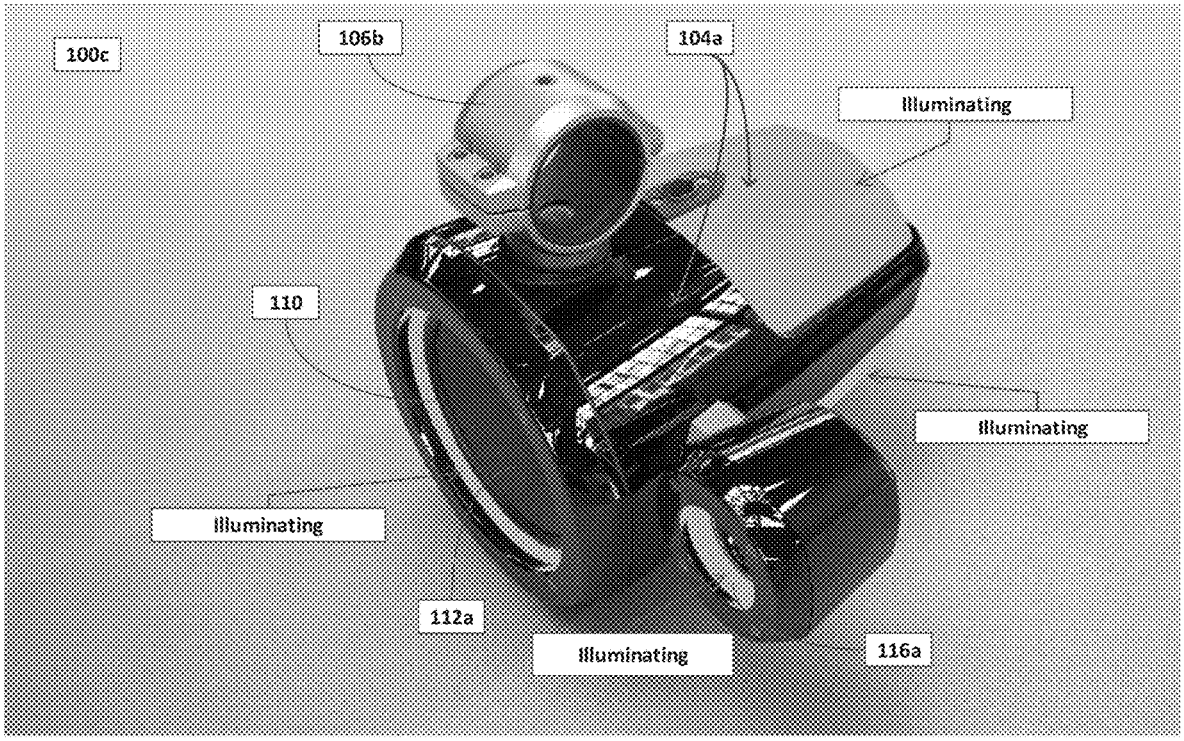
FIG. 13 is a perspective view of an example implementation of the speaker unit of FIG. 1 with the speaker housing in the illuminated configuration according to one or more example implementations of the disclosure.
Figure 14:
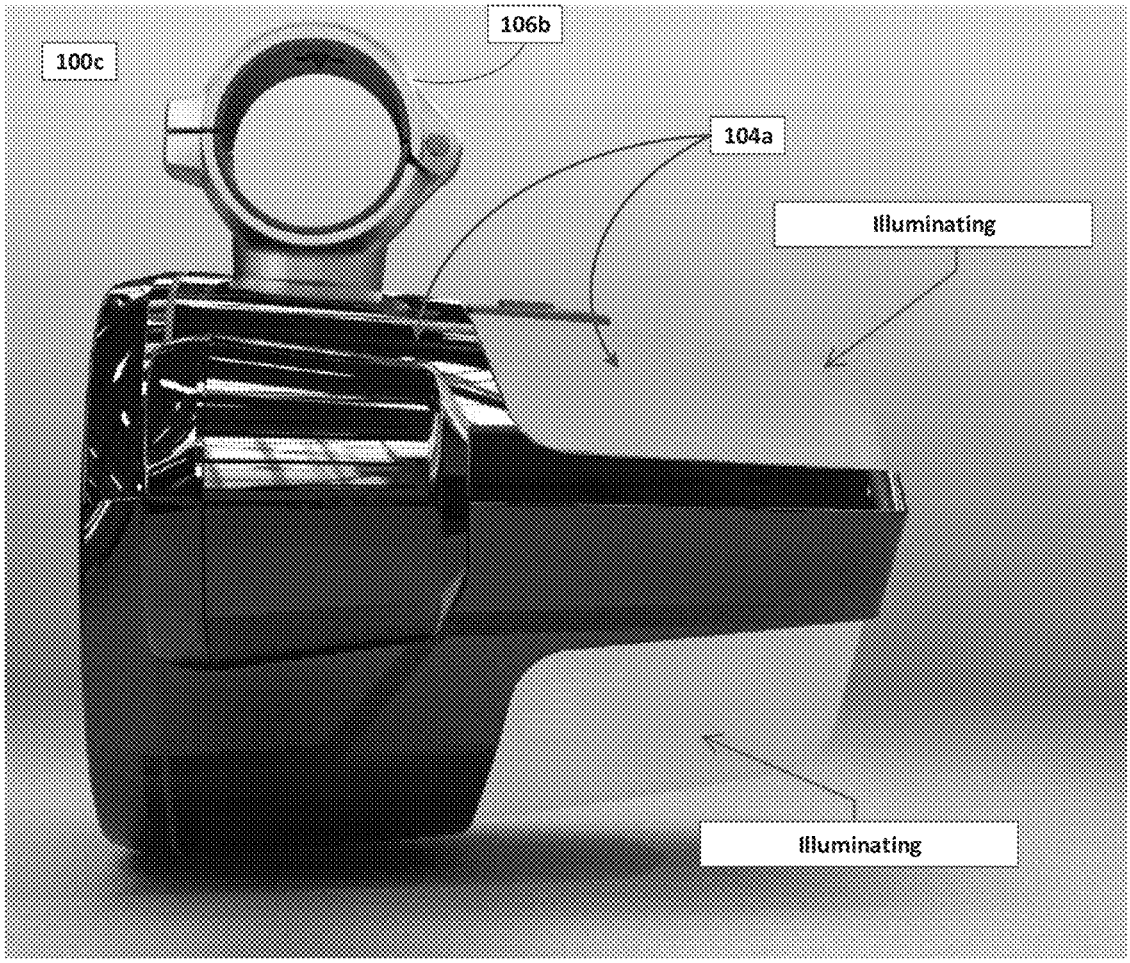
FIG. 14 is a side view of an example implementation of the speaker unit of FIG. 1 with the speaker housing in the illuminated configuration according to one or more example implementations of the disclosure.

In some implementations, a speaker housing (e.g., speaker housing 104) may at least partially include an audio speaker element (e.g., audio speaker element 108). As previously discussed above, speaker housing 104 may at least partially include audio speaker element 108 positioned within an interior portion of speaker housing 104. Consistent with this configuration, audio speaker element 108 may include speaker cone (or diaphragm) 112, and speaker coil (and magnet) 702. In some implementations, at least a portion of speaker cone 112 may be exposed to the exterior of the speaker unit (e.g., speaker unit 102*a* shown in FIG. 9). For example, and referring at least to the example embodiments in FIGS. 9-14, several illustrative example embodiments of speaker units consistent with the present disclosure are shown. Consistent with the illustrative example embodiments shown in FIGS. 9-14, the speaker units may include various portions of the speaker housing (e.g., speaker housings 104*a* shown in FIGS. 11-14), including various portions of bezel 110 at least partially surrounding at least a portion of speaker cone 112*a*. Consistent with some such embodiments, bezel 110 may be capable of being illuminated. In some implementations, the speaker housing may provide some degree of physical and/or environmental protection for one or more portions of the audio speaker element. For example, as shown in FIG. 9, the speaker housing may include speaker grill 900, which may be partially and/or entirely disposed over the bezel (e.g., via one or more screw fasteners shown in the depicted illustrative example embodiment). Consistent with the configuration shown in FIG. 9, speaker grill 900 may be configured to shield speaker internals and other audio components of the audio speaker element from foreign objects while still permitting transmission of sound from the audio speaker element. It will be appreciated that speaker grill 900 may be fastened over the bezel using various alternative means, e.g., screw cap, push to close, compression latch, adjustable lever, adhesives, welding, and/or any other suitable securement arrangement, consistent with the present disclosure.

In some implementations, at least a portion of the speaker housing may be open to an exterior environment, e.g., to allow satisfactory transmission of sound from the audio speaker element to the surrounding environment. In some implementations, the speaker housing may include an opening or port (not shown), to allow the satisfactory transmission of sound from an interior portion of the speaker housing, e.g., which may contain the audio speaker element.

In some implementations, and referring at least to the example embodiments of FIGS. 1-6 and 11-14, at least a second audio speaker element (e.g., second audio speaker element 114 identified in FIG. 1) may be connected to and extend from an exterior portion of speaker housing 104, 104*a*. For example, one or more illustrative example embodiments of a speaker unit consistent with the present disclosure are shown, in which FIGS. 1-6 and 11-14 may variously depict views of the speaker unit including an example embodiment of various portions of speaker housing 104, 104*a*, including an audio speaker element positioned at least partially within an interior portion of speaker housing 104, 104*a*, and a second audio speaker element (e.g., second audio speaker element 114) positioned on an exterior portion of speaker housing 104, 104*a*. Consistent with the depicted configuration, the second audio speaker element may include bezel 116, 116*a* (which may, in some embodiments, be of similar capacity to bezel 110) at least partially surrounding speaker cone 118, 118*a* (which may, in some embodiments, be of similar capacity to speaker cone 112). It will be appreciated that in at least some embodiments, the second audio speaker element and respective features (e.g., bezel 116, 116*a*) may share analogous aspects and/or capabilities to that of the audio speaker element (e.g., audio speaker element 108) and respective features consistent with the present disclosure.

In another example implementation, an apparatus for an audio sound system may include a speaker unit configured for use with outdoor recreational equipment. For example, a speaker unit 102 (including a speaker housing) may be constructed of water resistant material configured for providing waterproof protection during use with water sports and/or on watercraft vehicles. Consistent with this configuration, the speaker unit (including the speaker housing) may be constructed with UV resistant materials such that the speaker unit, including the speaker housing and respective internal features, may not degrade when exposed to sunlight.

In some implementations, a speaker unit may include a speaker housing configured to be selectively, at least partially, illuminated. At least a portion of the speaker housing may be at least one of at least partially translucent and at least partially transparent. For example, and referring at least to FIGS. 2 and 3, at least a portion (e.g., back can) of speaker housing 104 may be formed from at least a partially translucent and/or transparent material intended to be illuminated. Consistent with this configuration, at least a portion of speaker housing 104 that is not intended to be illuminated may be formed from one or more materials that are not translucent and/or transparent (e.g., opaque materials) to achieve such light-blocking effect. For example, and referring again to at least FIGS. 2 and 3, at least a portion of speaker housing 104 may be formed from an opaque material (and/or may include an opaque coating and/or overlying features) not intended to be illuminated. It will be appreciated that, while specific configurations have been shown, speaker housing 104 consistent with the present disclosure may be configured to provide any desired design or aesthetic for speaker unit 102, for instance, through the use of various housing shapes, colors, materials, and the like.

In some implementations, speaker unit 102 may further include illumination source 700 configured to at least partially illuminate speaker housing 104. For example, and referring again to at least FIGS. 7 and 8, speaker unit 102 may include a top emitting LED strip with a clear housing as illumination source 700 to provide a light emitting effect to speaker unit 102. In some implementations, speaker unit 102 may activate illumination source 700 (i.e., may power on or off) by voice command (e.g., using integral and/or remote voice sensing components, such as through smart-device integration) and/or electronic controller.

Illumination source 700 may be further configured to at least one of continuously and intermittently illuminate one or more selected portions of speaker housing 104. Illumination source 700 may be arranged such that light from illumination source 700 may be directed onto at least the portion of speaker housing 104 that is at least one of at least partially translucent and at least partially transparent. Illumination source 700 may be arranged such that light from illumination source may be directed within at least the portion of speaker housing 104 that is at least one of at least partially translucent and at least partially transparent.

In some implementations, illumination source 700 may include one or more illumination sources. As noted above, speaker unit 102 may include illumination source 700 positioned within an interior portion of speaker housing 104, wherein illumination source 700 may include one or more illumination sources configured to at least partially illuminate one or more translucent and/or transparent portions of speaker housing 104. Consistent with the present disclosure, illumination source 700 may utilize fiber optics, light cables, light pipes, etc., to transmit light from a remote light source to one or more desired portions of speaker housing 104, and/or to provide one or more desired patterns of illumination of desired portions of speaker housing 104

In some implementations, illumination source 700 may be configured to emit one or more illumination colors. As generally discussed above, in an example embodiment providing multiple illumination colors, the different illumination colors may be provided simultaneously, sequentially, or in an at least partially time-wise overlapping manner. In some embodiments, the color of the illumination may vary overtime. For example, the illumination may transition from one color to another color, wherein the transition from one color to another may occur to provide an effect of one color fading into a different color or color shade, or one color shifting into another color or color shade. Consistent with this configuration, different portions of the speaker housing may be illuminated in a different color or different color shade from one or more other portions of the speaker housing.

In some implementations, illumination source 700 may be configured to provide one or more different illumination intensities. As noted above, the one or more illumination sources may include a single illumination source or multiple illumination sources. For example, more than one different illumination intensity may be provided by a single illumination source, by different illumination sources providing respective different illumination outputs, and/or by multiple illumination sources providing different aggregate illumination outputs. In some embodiments, the illumination intensity may fade from one intensity to another and/or ramp up from one intensity to another. In some embodiments, different portions of speaker housing 104 may be illuminated at a different intensity from one or more other portions of speaker housing 104.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising." when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents (e.g., of all means or step plus function elements) that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

A number of implementations have been described. Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. An apparatus for an audio sound system, comprising:

a speaker housing comprising: a front end configured to secure a speaker therein; and a rear end comprising at least a lightable exterior panel that is transparent or translucent and that is secured within an opaque portion of the speaker housing;

an illumination source disposed within the speaker housing and configured to illuminate the lightable exterior panel; and a mounting apparatus secured to the speaker housing between the front end and the rear end and configured to secure the speaker housing in a stationary position relative to an external structure.

2. The apparatus according to claim 1, wherein the speaker housing is configured to secure the speaker in a forward firing orientation that is directly open into an environment surrounding the speaker housing.

3. The apparatus according to claim 1, the speaker housing further comprising a bezel that is configured to surround the speaker, that is separated from the lightable exterior panel by the opaque portion of the speaker housing, and that comprises bezel material that is transparent or translucent, wherein the illumination source is configured to illuminate the bezel material.

4. The apparatus of claim 1, wherein the illumination source is further configured to intermittently illuminate the lightable exterior panel portion of the speaker housing that is at least one of at least partially translucent and at least partially transparent.

5. The apparatus of claim 1, wherein the illumination source is configured to emit different illumination colors.

6. The apparatus of claim 1, further comprising the speaker.

7. The apparatus of claim 1, wherein the speaker housing further comprises an electrical receptacle configured to be connected to an external electrical power supply, wherein the electrical receptacle is located separate from the mounting apparatus.

8. The apparatus of claim 1, further comprising a second speaker housing that is discrete from and smaller than the speaker housing, that is secured directly to the speaker housing, and that is configured to secure a second speaker that is smaller than the speaker therein.

9. The apparatus of claim 8, wherein the second speaker housing comprises a second bezel that is configured to surround the second speaker and which comprises a second bezel material that is transparent or translucent.

10. An apparatus for an audio sound system, comprising:

a speaker housing comprising: a front end configured to secure a speaker therein; and a rear end comprising at least a lightable exterior panel that is transparent or translucent, that is secured in an opaque portion of the speaker housing, and that faces rearward;

an illumination source disposed within the speaker housing and configured to illuminate the lightable exterior panel; and a mounting apparatus secured to the speaker housing and configured to secure the speaker housing in a stationary position relative to an external structure.

11. The apparatus of claim 10, wherein the speaker housing is configured to secure the speaker in a forward firing orientation that is directly open into an environment surrounding the speaker housing.

12. The apparatus of claim 10, wherein the speaker housing is waterproof.

13. The apparatus of claim 10, wherein the mounting apparatus is secured to the speaker housing between the front end and the rear end.

14. The apparatus of claim 10, wherein the lightable exterior panel comprises a molded plastic that is shaped to emit light rearward and sideways.

15. The apparatus of claim 14, wherein the lightable exterior panel is a rear endcap of the speaker housing.

16. The apparatus of claim 14, wherein the lightable exterior panel is a rear corner of the speaker housing.

17. An apparatus for an audio sound system, comprising:

a speaker housing comprising: a front end configured to secure a speaker therein; and a rear end comprising at least a lightable exterior panel that is transparent or translucent, and that is secured within and fully surrounded by an opaque portion of the speaker housing;

an illumination source disposed within the speaker housing and configured to illuminate the lightable exterior panel; and a mounting apparatus secured to the speaker housing and configured to secure the speaker housing in a stationary position relative to an external structure other than a light bulb base.

18. The apparatus of claim 17, wherein the mounting apparatus comprises a multi-piece clamp.

19. The apparatus of claim 17, wherein the speaker housing further comprises an electrical receptacle configured to be connected to an external electrical power supply, wherein the electrical receptacle is located separate from the mounting apparatus.

20. The apparatus of claim 17, wherein the speaker housing is configured to secure the speaker in a forward firing orientation that is directly open into an environment surrounding the speaker housing.

* * * * *